US005788302A

United States Patent [19]

Barrash et al.

[11] Patent Number: 5,788,302

[45] Date of Patent: Aug. 4, 1998

[54] BOTTLE CARRIER

[75] Inventors: Marshall J. Barrash, Atlanta; Earl B. Ferguson, Marietta, both of Ga.

[73] Assignee: The Coca-Cola Company, Atlanta, Ga.

[21] Appl. No.: 832,996

[22] Filed: Apr. 4, 1997

[51] Int. Cl.[6] ..... B65D 71/00

[52] U.S. Cl. ..... 294/87.2; 206/148; 206/427; 294/159

[58] Field of Search ..... 294/27.1, 31.2, 294/87.1, 87.2, 87.22, 87.26, 87.28, 137, 159, 166, 170, 171; 206/139, 145, 147, 148, 150, 151, 199, 427, 459.5

[56] References Cited

U.S. PATENT DOCUMENTS

| | | | |
|---|---|---|---|
| D. 282,146 | 1/1986 | Wallin et al. . | |
| D. 307,712 | 5/1990 | Ralls et al. . | |
| 2,298,209 | 10/1942 | Gray | 294/87.2 |
| 2,427,838 | 9/1947 | Cox . | |
| 2,440,902 | 5/1948 | Lutey . | |
| 3,073,644 | 1/1963 | Baker et al. | 294/87.2 |
| 3,640,563 | 2/1972 | Wood | 294/87.2 |
| 3,804,309 | 4/1974 | Kwak . | |
| 3,834,750 | 9/1974 | Gauntlett . | |
| 3,912,140 | 10/1975 | Franges . | |
| 4,159,841 | 7/1979 | Calvert . | |
| 4,192,540 | 3/1980 | Oliff | 294/87.2 |
| 4,218,086 | 8/1980 | Klygis . | |
| 4,244,617 | 1/1981 | Manizza | 294/87.2 |
| 4,305,500 | 12/1981 | Jaeschke . | |
| 4,332,325 | 6/1982 | Manizza | 206/459.5 X |
| 4,378,878 | 4/1983 | Graser . | |
| 4,453,630 | 6/1984 | Helms et al. . | |
| 4,509,639 | 4/1985 | Thompson . | |
| 4,523,677 | 6/1985 | Schurmann . | |
| 4,917,428 | 4/1990 | Sola . | |
| 5,096,246 | 3/1992 | Cnare . | |
| 5,199,562 | 4/1993 | Adami et al. . | |
| 5,273,156 | 12/1993 | Harris . | |
| 5,290,083 | 3/1994 | Rissley . | |
| 5,306,060 | 4/1994 | Borg . | |
| 5,344,006 | 9/1994 | Mazzeo . | |
| 5,346,271 | 9/1994 | Erickson . | |
| 5,351,816 | 10/1994 | Sutherland et al. . | |
| 5,441,320 | 8/1995 | Strong . | |
| 5,445,262 | 8/1995 | Sutherland | 294/87.2 X |
| 5,476,170 | 12/1995 | Weber | 206/147 |
| 5,598,920 | 2/1997 | Hansen | 206/148 |
| 5,667,070 | 9/1997 | Miret | 294/87.2 X |

FOREIGN PATENT DOCUMENTS

| | | | |
|---|---|---|---|
| 6800147 | 7/1968 | Netherlands | 294/87.2 |

*Primary Examiner*—Johnny D. Cherry
*Attorney, Agent, or Firm*—Dennis W. Braswell

[57] ABSTRACT

A bottle carrier (10) is provided which includes an outer wall having openings (12 and 14) for inserting bottles. The outer wall includes sidewalls (24 and 26). The bottle is supported on shoulders (28 and 30).

20 Claims, 1 Drawing Sheet

BOTTLE CARRIER

TECHNICAL FIELD OF THE INVENTION

This invention relates generally to bottle carriers, and more particularly to a folded plastic bottle carrier.

BACKGROUND OF THE INVENTION

Many devices have been produced to assist consumers in carrying bottles, such as beverage bottles, from one place to another. These devices include plastic "six-pack" carriers, cardboard cartons, wire cages, and many other devices. The need for such devices is apparent: bottles can be bulky, and it may be difficult to carry several bottles at once, or even one bottle if it is relatively large.

Most of the existing bottle carriers have been designed with particular uses or types of bottles in mind. No matter what the use, common goals of bottle carrier design include making the carriers lightweight, long lasting, easy to use, and capable of securely holding the bottles while engaged.

Examples of lightweight, inexpensive bottle carriers are disclosed in U. S. Pat. Nos. 4,305,500, 4,218,086, and Des. 307,712. These and other prior art bottle carriers, however, present various drawbacks. For example, some are made of paper or cardboard, and therefore do not have a long life. As another example, many make it difficult to disengage the bottles.

Therefore, a need has arisen for a bottle carrier that achieves the desired goals and overcomes the problems associated with prior art bottle carriers.

SUMMARY OF THE INVENTION

In accordance with the teachings of the present invention, a bottle carrier is presented which substantially eliminates or reduces disadvantages and problems associated with prior art bottle carriers. In particular, a bottle carrier is provided which includes an outer wall with an opening for receiving a bottle. The outer wall is folded at a first and a second fold line, with the second fold line being separate from and opposite the first fold line. A first inner wall extends from the first fold line toward the opening, and includes a first shoulder separated from the first fold line. A second inner wall extends from the second fold line toward the opening, and has a second shoulder separated from the second fold line. The bottle is supported on the shoulders while being carried, and the bottle can be inserted or removed by increasing the separation between the shoulders. In a particular embodiment, two openings are provided, so as to provide a "twin-pack" bottle carrier.

In another embodiment, a main wall is provided which has a first wall and a second wall. The main wall includes one or more openings for receiving one or more bottles. A first shoulder is disposed between the first and second walls and adjacent the first wall. A second shoulder is disposed between the first and second walls and adjacent the second wall. One or more bottles are supported on the shoulders while being carried.

One technical advantage of the present invention results from the generally curved shape of the bottle carrier, which allows comfortable grasping of the bottle carrier. Furthermore, the generally curved structure of the bottle carrier assists in ensuring that bottles are securely engaged with the bottle carrier.

Another important technical advantage of one embodiment of the present invention is the fact that it includes double-wall sidewalls, for improved strength. Furthermore, both the double-wall sidewalls and single-wall sidewalls embodiments allow for the inclusion of decorative or marketing items, thereby increasing the aesthetic appeal or marketing functionality of the bottle carrier.

A BRIEF DESCRIPTION OF THE DRAWINGS

For a more complete understanding of the present invention and the advantages thereof, reference is now made to the following description taken in conjunction with the accompanying drawings in which like reference numbers indicate like features and wherein.

DETAILED DESCRIPTION OF THE DRAWINGS

Figure 1:
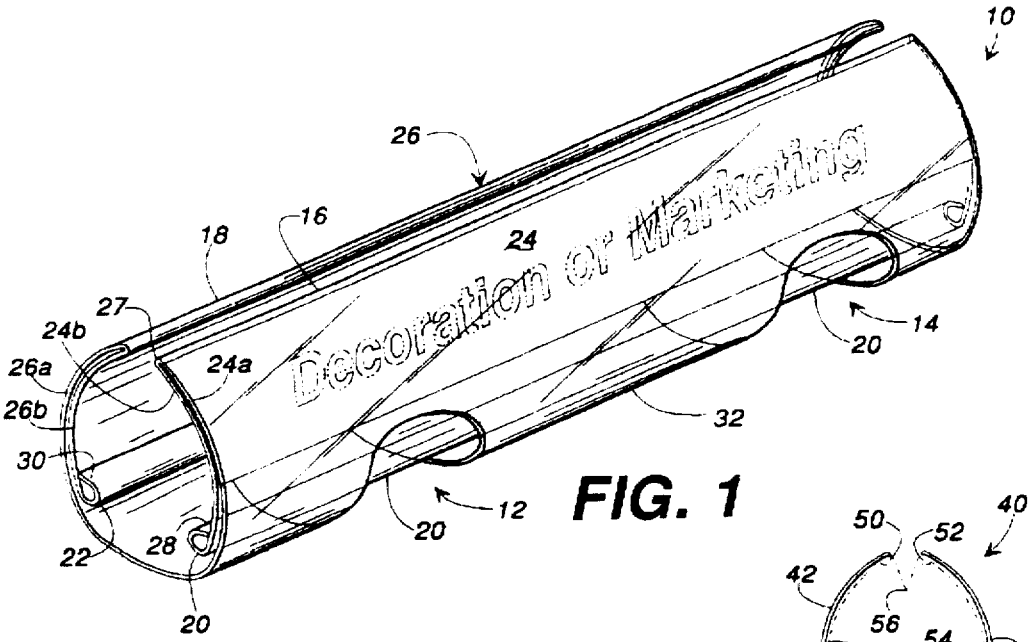
FIG. 1 illustrates an isometric view of a bottle carrier according to the teachings of the present invention.

FIG. 1 illustrates a bottle carrier 10 according to the teachings of the present invention. The particular bottle carrier 10 shown in FIG. 1 is designed to carry two bottles, and therefore includes two openings 12 and 14. These openings 12 and 14 are the openings through which the closure or finish area of the bottle is placed. Because the particular bottle carrier 10 shown in FIG. 1 is designed for two bottles, it is referred to as a "twin-pack" bottle carrier. It should be understood, however, that bottle carriers that accommodate more or less than two bottles are included within the intended scope of the present invention. The bottle carrier 10 is formed of a flexible plastic material, such as PET. However, other plastics may also be used without departing from the intended scope herein.

As shown in FIG. 1, bottle carrier 10 is of a generally rolled or oval shape, with an outer wall folded along lines 16 and 18. The bottle carrier 10 is also folded along lines 20 and 22. The folding of the bottle carrier 10 at lines 16 and 18 results in a bottle carrier with double-wall sidewalls 24 and 26. As shown in FIG. 1, double-wall sidewall 24 includes outside wall **24*a* and inside wall 24*b*. Similarly, double-wall sidewall 26 includes outside wall 26*a* and inside wall 26*b*. Outside walls 24*a* and 26*a* are parts of the overall outer wall of bottle carrier 10**, and may sometimes be referred to herein as sidewalls. As will be discussed below, double-wall sidewalls are not necessary, and single-wall sidewalls are included within the present invention.

The double-wall sidewalls 24 and 26 result in a bottle carrier that has significantly improved strength over prior art bottle carriers. Furthermore, the double-wall structure allows for the insertion of items between the walls of each double-wall. For example, an advertising or decorative display, for example made of paper or plastic, can be inserted between the walls **24*a* and 24*b* of sidewall 24. Because the bottle carrier 10 may be formed of clear plastic, such items will be visible and improve the aesthetic or marketing effectiveness of the bottle carrier. As can be seen in FIG. 1, an example of a decorative or marketing item 27 is shown as being placed between the walls 24*a* and 24*b* of sidewall 24. The particular item 27** shown is a printed item, although any suitable item may be included.

As shown in FIG. 1, the inside walls 24b and 26b are folded at lines 20 and 22, respectively. At these fold lines, the inside walls 24b and 26b are rolled to form shoulders 28 and 30. The shoulders 28 and 30 form a secure seat for supporting bottles being carried. Shoulders 28 and 30 could also be formed integrally with the inside walls 24b and 26b, without the need for folding or rolling. Similarly, shoulders 28 and 30 could be formed integrally on the inside of the outside walls 24a and 26a. Also, the shoulders 28 and 30 need not run the length of the bottle carrier 10, but can also be dispersed only proximate the openings 12 and 14.

Figure 2:
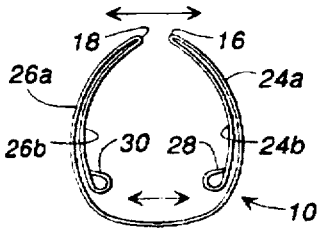
FIG. 2 illustrates a side view of bottle carrier according to the teachings of the present invention.

FIG. 2 illustrates a side view of bottle carrier 10, illustrating shoulders 28 and 30. In use, a bottle is inserted (or removed) by separating fold lines 16 and 18, as indicated by the arrow of FIG. 2. As the distance between fold lines 16 and 18 is increased, so is the difference between shoulders 28 and 30, thereby allowing bottles to be easily inserted or removed from the bottle carrier 10. Once the bottles are inserted, the bottle carrier 10 can be grasped at its central location, for example area 32 of FIG. 1, to lift the bottles. The grasping and lifting of the bottle carrier 10 can cause the fold lines 16 and 18, and shoulders 28 and 30, to move closer together, thereby assisting in the locking-in of the bottles, by insuring that the shoulders 28 and 30 are pressed securely to the bottles being carried. The generally rounded shape of bottle carrier 10 fits nicely in the hand, thereby allowing for easy gripping and carrying.

An important technical advantage of the present invention inheres in the fact that the sidewalls 24 and 26 are curved, with the shoulders 28 and 30 residing at a location below the fold lines 16 and 18. With the shoulders 28 and 30 below these fold lines 16 and 18, downward force on the shoulders 28 and 30 can draw the fold lines 16 and 18 closer together, which can result in shoulders 28 and 30 snugly pressing against the bottle being carried, and insuring a secure fit. Furthermore, the greater the bottle weight, the greater the tendency to grasp the carrier tighter, thereby increasing the locking force of shoulders 28 and 30 on the finish ring 36 of bottle 34.

Figure 3:
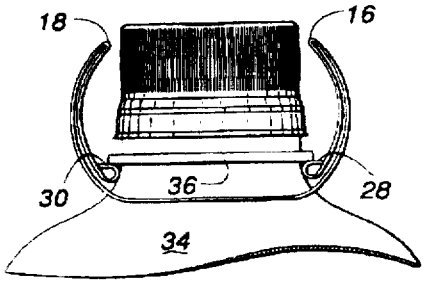
FIG. 3 illustrates a side view of a bottle carrier according to the teachings of the present invention when engaged with a typical bottle.

FIG. 3 illustrates a bottle 34 engaged within bottle carrier 10. As shown in FIG. 3, the finish ring 36 of bottle 34 is supported by shoulders 28 and 30 of the bottle carrier 10. The bottle 34 is inserted and removed from the bottle carrier 10 by simply increasing the distance between fold lines 16 and 18, which increases the distance between shoulders 28 and 30, thereby allowing a wide enough opening for the bottle 34 to pass through. Although finish ring 36 is illustrated, any similar bottle feature may be seated on shoulders 28 and 30.

Figure 4:
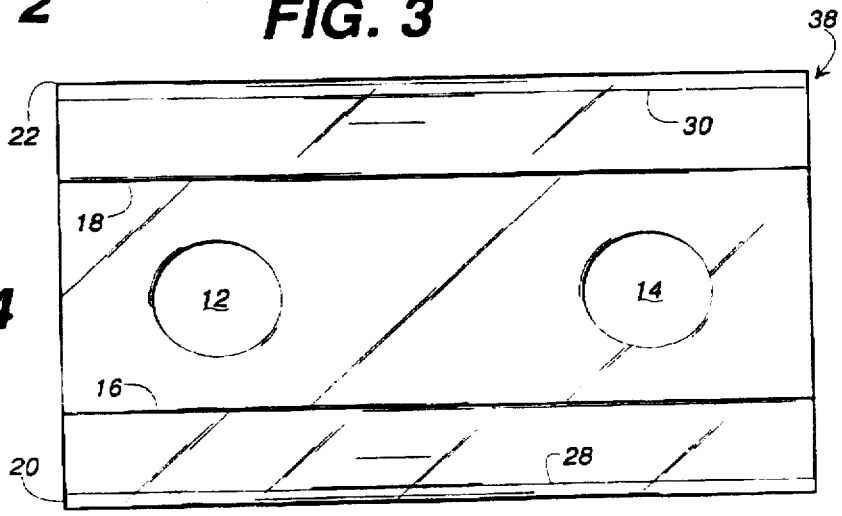
FIG. 4 illustrates an unfolded view of a bottle carrier according to the teachings of the present invention.

FIG. 4 illustrates a piece of plastic 38 from which bottle carrier 10 may be formed. The piece of plastic 36 is folded along lines 16, 18, 20 and 22. After this folding, the piece of plastic is rolled by the process of thermoforming so as to provide the generally rounded shape shown in FIG. 1. Then openings 12 and 14 are also formed in the piece of plastic 38.

Figure 5:
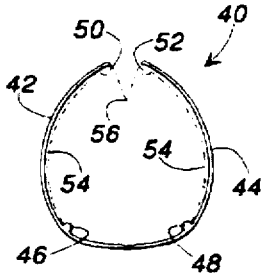
FIG. 5 illustrates a single-wall sidewalls embodiment according to the teachings of the present invention.

In another embodiment, as shown in FIG. 5, single-wall sidewalls 42 and 44 may be used with integrally formed shoulders 46 and 48, thus eliminating the need for double-wall sidewalls and folds. This single-wall embodiment may be made by extrusion or injection molding, among other techniques, and functions similarly to bottle carrier 10 of the other FIGURES. Thus, bottles being carried rest on shoulders 46 and 48.

Decorative or marketing items 54 are held in place between shoulders 46 and 50, and 48 and 52, respectively. Shoulders 50 and 52 may be eliminated if items 54 are not used, or if a single, continuous, item 54 is used. With a continuous item 54, a fold 56 in item 54 is preferably used (though not required) to assist in maintaining item 54 lodged against shoulders 46 and 48 when sidewalls 42 and 44 are separated.

In summary, a plastic bottle carrier is provided which includes double-wall sidewalls or single-wall sidewalls, and which allows the inclusion of advertising or decorative items. Each sidewall snugly supports such marketing or decorative items, which may include printed plastic or paper items. Furthermore, the shoulders provide a secure landing location for bottles being carried.

Although the present invention has been described in detail, it should be understood that various alterations, modifications, or substitutions can be made without departing from the intended scope of the present invention as defined by the appended claims.

What is claimed is:

1. A bottle carrier, comprising:

an outer wall including an opening for receiving a bottle;

a first fold line on said outer wall;

a second fold line on said outer wall, said second fold line separate from and opposite said first fold line;

a first inner wall extending from said first fold line toward said opening, said first inner wall having a first shoulder separated from said first fold line; and a second inner wall extending from said second fold line toward said opening, said second inner wall having a second shoulder separated from said second fold line;

such that the bottle is supported on both of said shoulders while being carried, and the bottle can be inserted or removed by increasing the separation between said shoulders.

2. The bottle carrier of claim 1, and further comprising a printed item disposed between said outer wall and said first inner wall.

3. The bottle carrier of claim 1, wherein said bottle carrier is formed of plastic.

4. The bottle carrier of claim 1, wherein said outer wall includes a plurality of openings.

5. The bottle carrier of claim 1, wherein:

said first inner wall includes a first shoulder fold line at which said first inner wall is folded to form said first shoulder; and said second inner wall includes a second shoulder fold line at which said second inner wall is folded to form said second shoulder.

6. The bottle carrier of claim 1, wherein said outer wall is curved.

7. A bottle carrier, comprising:

a curved outer wall including a first outside wall and a second outside wall, said curved outer wall including an opening for receiving a bottle;

a first fold line on said first outside wall;

a second fold line on said second outside wall;

a first inner wall extending from said first fold line toward said opening, said first inner wall having a first shoulder separated from said first fold line; and a second inner wall extending from said second fold line toward said opening, said second inner wall having a second shoulder separated from said second fold line;

such that the bottle is supported on both of said shoulders while being carried, and the bottle can be inserted or removed by increasing the separation between said shoulders.

8. The bottle carrier of claim 7, and further comprising a printed item disposed between said first outside wall and said first inner wall.

9. The bottle carrier of claim 7, wherein said bottle carrier is formed of plastic.

10. The bottle carrier of claim 7, wherein said outer wall includes a plurality of openings.

11. The bottle carrier of claim 7, wherein:

said first inner wall includes a first shoulder fold line at which said first inner wall is folded to form said first shoulder; and said second inner wall includes a second shoulder fold line at which said second inner wall is folded to form said second shoulder.

12. A bottle carrier, comprising:

a main wall having a first wall and a second wall, said main wall including an opening for receiving a bottle;

a first shoulder disposed between said first and second walls and adjacent said first wall; and a second shoulder disposed between said first and second walls and adjacent said second wall;

such that the bottle is supported on both of said shoulders while being carried.

13. The bottle carrier of claim 12, wherein said bottle carrier is formed of plastic.

14. The bottle carrier of claim 12, wherein said main wall includes a plurality of openings.

15. The bottle carrier of claim 12, wherein said main wall is curved.

16. The bottle carrier of claim 12, and further comprising:

a third shoulder disposed adjacent said first wall and spaced apart from said first shoulder;

a printed item disposed between said first and third shoulders.

17. A bottle carrier, comprising:

a main outer wall having a first outside wall and a second outside wall, said main wall including an opening for receiving a bottle;

a first inside wall adjacent said first outside wall;

a second inside wall adjacent said second outside wall; and first and second shoulders between said first and second outside walls;

such that the bottle is supported on both of said shoulders while being carried.

18. The bottle carrier of claim 17, wherein said outer wall includes a plurality of openings.

19. The bottle carrier of claim 17, wherein said outer wall is curved.

20. The bottle carrier of claim 17, and further comprising a printed item inserted between said first outside wall and first inside wall.

* * * * *